United States Patent [19]

Kullman et al.

[11] 3,970,424

[45] July 20, 1976

[54] DURABLE PRESS TREATMENT BY ADDITION OF SODIUM DIHYDROGEN PHOSPHATE TO ALUMINUM SULFATE CATALYST

[75] Inventors: Russell M. H. Kullman, Metairie; Robert M. Reinhardt, New Orleans, both of La.

[73] Assignee: The United States of America as represented by the Secretary of Agriculture, Washington, D.C.

[22] Filed: Aug. 14, 1975

[21] Appl. No.: 604,853

[52] U.S. Cl. ..... 8/185; 427/390; 428/288

[51] Int. Cl.[2] ..... D06M 13/40

[58] Field of Search ..... 8/185; 427/390 C; 428/288

[56] References Cited

UNITED STATES PATENTS

| | | | |
|---|---|---|---|
| 3,006,879 | 10/1961 | Ryan et al. | 428/288 |
| 3,224,926 | 12/1965 | Bernardin | 428/364 |
| 3,708,261 | 1/1973 | Kaspar et al. | 427/390 C |

*Primary Examiner*—Donald Levy
*Assistant Examiner*—Maria S. Tungol
*Attorney, Agent, or Firm*—M. Howard Silverstein; Max D. Hensley

[57] ABSTRACT

Improvement in strength and elimination of coloration are achieved in fabrics finished for durable press properties by treatment with an N-methylol amide cross-linking agent and aluminum sulfate catalyst when sodium dihydrogen phosphate is included in the finishing formulation. These effects are achieved when the weight ratio of sodium dihydrogen phosphate to aluminum sulfate is 2.05.

4 Claims, No Drawings

DURABLE PRESS TREATMENT BY ADDITION OF SODIUM DIHYDROGEN PHOSPHATE TO ALUMINUM SULFATE CATALYST

This invention relates to an improved process for obtaining durable press fabrics which have no coloration and higher strength than normally encountered in fabrics treated for durable press properties with an N-methylol amide crosslinking agent and aluminum sulfate catalyst. Specifically, this invention relates to addition of sodium dihydrogen phosphate to formulations containing an N-methylol amide crosslinking agent and aluminum sulfate so that fabrics treated with said formulations for durable press properties will benefit by having no coloration and higher strength than fabrics similarly treated in the absence of sodium dihydrogen phosphate.

THE PRIOR ART

Catalysts suitable for promoting the crosslinking of cellulosic materials by reaction between an N-methylol amide agent and the cellulosic material have been important in the textile field for many years. Interest in catalysts has increased greatly in the past two decades as the production of durable press articles and their commercial acceptance have become very important to the textile industry and the consumer. Most catalysts are either weak or strong acids, or compounds with latent acidic properties such as ammonium or metal salts. The function of the catalyst is to accelerate the crosslinking reaction but with minimal degradative action on the textile substrate, i.e., loss of strength through hydrolysis of linkages in the cellulose chain, coloration, and the like. At present, there is a demand for catalysts that do not contain chlorine to preclude formation of bis(chloromethyl)ether through side reactions that may occur during the finishing operation. Also, catalysts are needed that do not contain heavy metals which may contribute to stream pollution. The salts of only two metals have any practical promise to meet these needs, e.g., magnesium and aluminum salts, as other effective catalysts are salts of heavy metals or are highly colored salts.

The aluminum salts, particularly $AlCL_3$, $Al(NO_3)_3$, and $Al_2(SO_4)_3$, are stronger catalysts than the corresponding magnesium salts and theoretically preferable, especially in finishing operations with fast cures at high temperatures. Aluminum chloride is not desirable as a catalyst in finishing, however, due to both its degradative action on cellulose and the presence of chlorine. Aluminum nitrate also is very strong (in fact, it may be employed to oxidize cellulose) and results in tendering and yellowing of the fabric. Similarly, aluminum sulfate is an effective catalyst for the reaction of an N-methylol amide crosslinking agent with cellulose but it, too, causes large strength losses and yellowing of finished fabric at curing temperatures of 140°C. and higher.

OBJECT OF THE INVENTION

It is an object of this invention to provide an improved process with aluminum sulfate as catalyst for finishing cellulose-containing textiles that results in increased strength in the finished fabrics with no adverse coloration and without loss of durable press performance. The importance of an improved fabric strength without coloration or detrimental effect to durable press performance is readily apparent to those skilled in the art.

HOW THE OBJECT IS ACHIEVED

We have found that inclusion of sodium dihydrogen phosphate in formulations containing an N-methylol amide crosslinking agent and aluminum sulfate catalyst for the treatment of cellulose-containing fabric to impart durable press properties provides a means to obtain a treated material without coloration and with greater strength than when the sodium dihydrogen phosphate is omitted. Durable press performance of fabrics finished by the improved process is better than when sodium dihydrogen phosphate alone is used as catalyst and fabric strength is far superior to that when only aluminum sulfate is used as catalyst.

The textile material for treatment by the improved process is generally in fabric form but may be in other forms such as nonwoven materials, knits, yarns, or fibers. Fabrics may be composed of cotton, other natural cellulosic fibers such as linen, ramie, and the like, or any combination of such natural fibers. It also is within the scope of this invention to include regenerated fibers as cellulosic components and to include fabrics composed of blends of cellulosic fibers with other manmade fibers as well.

Any N-methylol amide crosslinking agent may be employed in the improved process but dimethylol dihydroxyethyleneurea, hereinafter referred to as DMDHEU, is the agent selected for purposes of demonstrating the improved process. The concentration of DMDHEU may vary in weight percent of the total treatment bath from about 5% to about 25% with a preferred range of about from 8% to about 16%.

The mixture of sodium dihydrogen phosphate and aluminum sulfate may be varied in weight percent ratio from 2 to about 4. The total weight percent concentration of the catalyst mixture in the treatment bath may be varied from about 0.5% to about 8%; the preferred range is 1.3 to 5.4%. Fabric Fabric with the treatment solution containing the N-methylol amide crosslinking agent and catalyst mixture may be accomplished by any suitable means. It is common practice to immerse fabric in the treatment solution, often referred to as the pad bath, to thoroughly saturate the fibers and then pass the fabric through squeeze rolls to adjust the amount of solution on the fabric and to assure good penetration and distribution of the crosslinking agent and catalyst. The wet pickup may range from about 50 to 120% based on the dry weight of the untreated fabric. The preferred range depends on the particular fibers in the fabric. For 100% cotton, the preferred range is 70–90%.

Fabric impregnated with the treatment solution is dried under conditions such that substantially no reaction takes place between the finishing agent and cellulose. The dried fabric is then heat treated to bring about the reaction whereby the cellulosic chains are crosslinked. Conditions for this heat treatment step range from about 140° to about 200°C. (about 284° to 392°F.) for from about 20 seconds to about 3 minutes, time and temperature being inversely adjusted. The exact conditions required vary with the equipment used and the material being treated.

Once cured, fabric is suitable for utilization in end products for which the fabric is designed, however, we have found it good practice to remove residual water soluble chemicals from the cured fabric by washing.

SUMMARY OF THE INVENTION

The improved process of this invention may be described as one in which a catalyst system, containing sodium dihydrogen phosphate and aluminum sulfate in a weight ratio of the former to the latter of 2.05, is employed with an N-methylol amide crosslinking agent to produce a durable press fabric.

The following examples describe the invention in further detail. They are provided for illustrative purposes and are not intended to limit the scope or spirit of the invention as will be understood by those skilled in the art.

EXAMPLE 1

Samples of desized, scoured and bleached cotton printcloth were impregnated to wet pickups of about 90% with aqueous solutions, 100 grams of which contained 9 grams of dimethylol dihydroxyethyleneurea (DMDHEU) and:

SAMPLE 1A: 0.88 gram of $Al_2(SO_4)_3$;
SAMPLE 1B: 1.76 grams of $Al_2(SO_4)_3$; and
SAMPLE 1C: 3.52 grams of $Al_2(SO_4)_3$.

The wet, impregnated fabrics were pinned on frames, dried for 7 minutes at 60°C., and cured for 3 minutes at 160°C. in forced air-circulation ovens. The treated samples were analyzed and tested after washing. Durable press (DP) ratings were determined after washing and tumble drying by the procedure of AATCC Test Method 124-1969 (AATCC Technical Manual, Volume 46, pages 177–178, 1970); wrinkle recovery angles were determined by AATCC Test Method 66-1968 (AATCC Technical Manual, Volume 46, pages 256–257, 1970); breaking strengths were determined on 1-inch strips by ASTM Method D1682-64; and nitrogen contents by the Kjeldahl method. Coloration of the fabric after curing and after washing was observed visually and compared to the untreated fabric. Coloration which occurred during the cure was permanent in that it was not removed in washing. Results are shown in Table I.

TABLE I

| Sample | Wt. % $Al_2(SO_4)_3$ in pad bath | % N | DP Rating | Wrinkle Recovery Angle, W+F, deg. | | Brk. Str. W, lbs. | Coloration |
|---|---|---|---|---|---|---|---|
| | | | | Condition-ed | Wet | | |
| 1A | 0.88 | 1.08 | 3.7 | 283 | 273 | 16.6 | Faint yellow |
| 1B | 1.76 | 1.02 | 4.5 | 283 | 269 | 13.1 | Very light yellow |
| 1C | 3.52 | 0.90 | 4.5 | 296 | 282 | 10.9 | Yellow |
| Untreated | — | — | 1.0 | 196 | 162 | 48.6 | None |

Aluminum sulfate functions effectively as a catalyst in promoting reaction between the crosslinking agent (DMDHEU) and cellulose to obtain high levels of durable press smoothness and high levels of wrinkle recovery, but the strength loss and coloration are serious disadvantages. These results also demonstrate that although catalytic effectiveness of this salt is good even at the low concentration level, coloration produced during the curing operation cannot be avoided.

EXAMPLE 2

Samples of cotton printcloth were impregnated to wet pickups of about 90% with aqueous solutions, 100 grams of which contained 9 grams of DMDHEU and:

SAMPLE 2A: 1.20 grams of $NaH_2PO_4$;
SAMPLE 2B: 2.40 grams of $NaH_2PO_4$; and
SAMPLE 2C: 3.60 grams of $NaH_2PO_4$.

The wet, impregnated fabrics were dried, cured, and washed as described in Example 1, and evaluated. Results are shown in Table II.

TABLE II

| Sample | Wt. % $NaH_2PO_4$ in pad bath | % N | DP Rating | Wrinkle Recovery W+F, deg. | | Brk. Str. W, lbs. |
|---|---|---|---|---|---|---|
| | | | | Condition-ed | Wet | |
| 2A | 1.20 | 0.74 | 3.2 | 238 | 216 | 34.7 |
| 2B | 2.40 | 0.82 | 3.2 | 254 | 241 | 33.4 |
| 2C | 3.60 | 0.84 | 3.3 | 265 | 248 | 30.8 |

Obviously $NaH_2PO_4$ is not as effective a catalyst as $Al_2(SO_4)_3$ in promoting the crosslinking reaction. This is reflected in the lower nitrogen contents of Samples 2A, 2B, and 2C as compared to those of Samples 1A, 1B, and 1C of Example 1. The smooth appearance after laundering necessary for durable press performance also is considerably lower with $NaH_2PO_4$ catalysis than with $Al_2(SO_4)_3$ catalysis. Durable press ratings after tumble drying, which are particularly important for durable press garments, are barely above 3 which is generally considered to be marginally acceptable. Comparison of Sample 1C to 2C, treated with comparable weight percent concentrations of catalysts in the finishing bath, amply demonstrates the superiority of catalysis by $Al_2(SO_4)_3$ over that of $NaH_2PO_4$. As shown in Table I, however, Sample 1C is badly discolored.

EXAMPLE 3

Samples of cotton printcloth were impregnated to wet pickups of about 90% with aqueous solutions, 100 grams of which contained 9 grams of DMDHEU and:

SAMPLE 3A: 1.2 grams of $NaH_2PO_4$ and 3.52 grams of $Al_2(SO_4)_3$, the weight ratio of $NaH_2PO_4$ to $Al_2(SO_4)_3$ being 0.34;

SAMPLE 3B: 2.40 grams of $NaH_2PO_4$ and 3.52 grams of $Al_2(SO_4)_3$, the weight ratio of $NaH_2PO_4$ to $Al_2(SO_4)_3$ being 0.68;

SAMPLE 3C: 3.60 grams of $NaH_2PO_4$ and 3.52 grams of $Al_2(SO_4)_3$, the weight ratio of $NaH_2PO_4$ to $Al_2(SO_4)_3$ being 1.02; and SAMPLE 3D: 3.60 grams of $NaH_2PO_4$ and 1.76 grams of $Al_2(SO_4)_3$, the weight ratio of $NaH_2PO_4$ to $Al_2(SO_4)_3$ being 2.05.

The wet, impregnated samples were dried, cured, and washed as described in Example 1, and evaluated. In Table III are listed durable press ratings after tumble drying and visual observations on the coloration of the treated fabrics.

TABLE III

| Sample | Wt. % $NaH_2PO_4$ in pad bath | Wt. % $Al_2(SO_4)_3$ in pad bath | $NaH_2PO_4$ : $Al_2(SO_4)_3$ (Wt. % : Wt. %) | Coloration | DP Rating |
|---|---|---|---|---|---|
| 3A | 1.20 | 3.52 | 0.34 | Yellow | 3.9 |
| 3B | 2.40 | 3.52 | 0.68 | Light yellow | 4.3 |
| 3C | 3.60 | 3.52 | 1.02 | Very light yellow | 4.0 |
| 3D | 3.60 | 1.76 | 2.05 | None | 4.0 |

This table demonstrates that coloration of the finished fabric which developes during the curing step with $Al_2(SO_4)_3$ catalyst can be completely eliminated by addition of $NaH_2PO_4$ to the treatment bath. It further demonstrates that a weight ratio of approximately 2 : 1 [$NaH_2PO_4$ : $Al_2(SO_4)_3$] is necessary to obtain a finished fabric with no coloration. It is particularly surprising and unexpected as Sample 1A from treatment with only 0.88% by weight of $Al_2(SO_4)_3$ as catalyst had coloration whereas Sample 3D from the treatment with 1.76% $Al_2(SO_4)_3$, but in the presence of $NaH_2PO_4$, did not sustain any color change.

The durable press performance also is maintained at a high level. A plot, made of the breaking strengths of Samples 1B, 3A, 3B, 3C, and 3D is shown below.

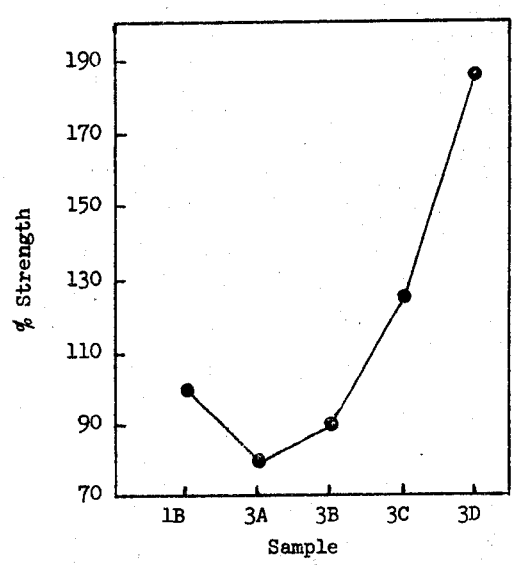

The % strength is based on that of Sample 1B in which only $Al_2(SO_4)_3$ was used as catalyst. The dramatic improvement in strength of fabrics treated with $NaH_2PO_4$ in the formulations wherein the weight ratio of $NaH_2PO_4$ to $Al_2(SO_4)_3$ is 1.02 (Sample 3C) or higher (as in Sample 3D) is totally unexpected. From results of Table III and the above plot it is readily demonstrated that an outstanding improvement in fabric strength can be achieved in addition to complete elimination of coloration of the treated fabric by use of the proper combination of $NaH_2PO_4$ and $Al_2(SO_4)_3$.

EXAMPLE 4

Samples of cotton printcloth were impregnated to wet pickups of about 90 % with aqueous solutions, 100 grams of which contained 9 grams of DMDHEU and:

SAMPLE 4A: 0.90 gram of $NaH_2PO_4$ and 0.44 gram of $Al_2(SO_4)_3$, the weight ratio of $NaH_2PO_4$ to $Al_2(SO_4)_3$ being 2.05 and total catalyst weight being 1.3%;

SAMPLE 4B: 1.80 grams of $NaH_2PO_4$ and 0.88 gram of $Al_2(SO_4)_3$, the weight ratio of the salts being the same as for Sample 4A and total catalyst weight being 2.68%;

SAMPLE 4C: 2.70 grams of $NaH_2PO_4$ and 1.32 grams of $Al_2(SO_4)_3$, the weight ratio of the salts being the same as for Sample 4A and total catalyst weight being 4.02%.

The wet, impregnated samples were dried, cured, and washed as described in Example 1, and evaluated. A plot of strength and durable press rating after tumble drying is shown below.

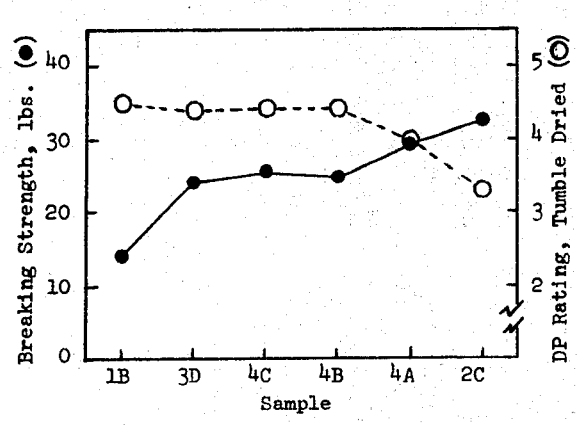

Not only is high durable press performance retained but, to our surprise, high strength is achieved and maintained in fabric treated with catalysis by a wide range of concentrations in which the weight ratio of $NaH_2PO_4$ to $Al_2(SO_4)_3$ is 2.05.

We claim:

1. In a process for producing durable press textiles comprising impregnating cellulose-containing fabric with aqueous formulations containing an N-methylol amide crosslinking agent and aluminum sulfate catalyst, drying, and curing the fabric, the improvement which consists of adding sodium dihydrogen phosphate to said formulations to give finished fabrics with increased strength and no coloration.

2. An improved process for finishing cellulose-containing textiles to impart durable press properties with improved strength and no coloration, the process comprising impregnating a cellulose-containing textile with a formulation in which sodium dihydrogen phosphate is added to an aqueous solution containing an N-methylol amide crosslinking agent and aluminum sulfate so that in 100 parts by weight of formulation there are about from 5 to 25 parts by weight of the N-methylol amide crosslinking agent, about from 0.44 to 1.76 parts by weight of aluminum sulfate, and about from 0.90 to 3.60 parts by weight of sodium dihydrogen phosphate, the weight ratio of sodium dihydrogen phosphate to aluminum sulfate being at least 2.05, drying, and curing the impregnated fabric.

3. The process of claim 2 wherein the N-methylol amide crosslinking agent is dimethylol dihydroxyethyleneurea.

4. A cellulose-containing fabric treated by the process of claim 2.

* * * * *